US006967580B1

(12) United States Patent
Schulze

(10) Patent No.: US 6,967,580 B1
(45) Date of Patent: Nov. 22, 2005

(54) EMERGENCY AND DISABLED PERSONS COMMUNICATION BUSINESS MODEL ALGORITHM AND METHOD AND APPARATUS

(76) Inventor: Herbert C. Schulze, 2790 Wrondel Way, PMB36, Reno, NV (US) 89502

( * ) Notice: Subject to any disclaimer, the term of this patent is extended or adjusted under 35 U.S.C. 154(b) by 50 days.

(21) Appl. No.: 10/351,092

(22) Filed: Jan. 22, 2003

(51) Int. Cl.[7] ..... G08B 23/00

(52) U.S. Cl. ..... 340/573.7; 340/573.1; 340/568.1; 340/541; 455/401; 455/404.1; 200/61.45 R; 200/61.45 M; 73/652; 345/156; 345/161

(58) Field of Search ..... 340/573.1, 568.1, 340/541, 545.5; 455/401, 404.1; 200/61.45 R, 200/61.45 M, 61.5 Z; 73/652; 345/161, 156

(56) References Cited

U.S. PATENT DOCUMENTS 488,986 A * 1/1893 Baer ..... 112/119
4,168,410 A * 9/1979 Norris ..... 200/61.45 R
4,697,174 A * 9/1987 Viator, Sr. ..... 340/689
5,017,748 A * 5/1991 Sapiro ..... 200/84 C
5,148,150 A * 9/1992 White et al. ..... 340/571
6,437,703 B1 * 8/2002 Fong ..... 340/689

* cited by examiner

*Primary Examiner*—Daniel Wu
*Assistant Examiner*—Samuel J. Walk

(57) ABSTRACT

This invention is an algorithm and method and apparatus for communication in emergency situations and for persons who are disabled. The invention features unique telephone actuation means including overt and covert means both by wired devices and wireless transmission to detect unwanted intruders or the like and to communicate the need for assistance or the existence of emergency or dangerous conditions. Communication activation methods and apparatus usable by disabled or endangered persons and/or unknowingly operable by reason of unauthorized intrusion and the like is provided. Unique motion activated notification devices utilizing disc magnets in tracks associated with magnetic switches are also disclosed.

1 Claim, 9 Drawing Sheets

EMERGENCY AND DISABLED PERSONS COMMUNICATION BUSINESS MODEL ALGORITHM AND METHOD AND APPARATUS

CROSS REFERENCE TO RELATED PATENT APPLICATIONS

This application is related to my application Ser. No. 09/898,112, filed Jul. 2, 2001, now abandoned.

BACKGROUND OF THE INVENTION

I. Field of the Invention

This invention is titled "Emergency and Disabled Persons Communication Business Model Algorithm and Method and Apparatus". This title was selected as this invention is an Algorithm involving a step by step method as explained and defined by the Court of Appeals for the Federal Circuit in State Street Bank & Trust Co. v. Signature Financial Group, Inc. in which the Court stated "—every step-by-step process, be it electronic or chemical or mechanical involves an algorithm in the broad sense of the term—". It is also a method and a means or apparatus.

This invention is in the general fields of alarms and communications monitoring and activation systems and equipment;

The invention is more particularly in the fields of silent alarms, emergency and invalid monitoring, and silent activation of telephones and the like;

The invention is even more particularly directed to the field of activation of alarms or monitoring or communication devices which are activated overtly, or covertly, by merely disturbing or imparting motion to an article or communication circuitry.

II. Description of the Prior Art

There are many emergency alarm and monitoring systems and communication devices, too numerous to detail here. All heretofore available emergency alarm and monitoring systems require installation of elaborate telephone or other equipment.

Additionally, all heretofore known or available alarm or monitoring systems required a reasonable degree of mental/physical coordination for the pressing of buttons, or the like.

The present invention requires only a minute ability to contact, or move, an object in order to sound an alarm or monitor a location, give the location, enable one at a distance from the location to know the location, and obtain knowledge of activities at the location sending the alarm or being monitored. The manner in which the present invention works is that a telephone or the like is activated by means of an impact or motion-sensing switch or the like.

The prior art known to me is contained in the following U.S. Pat. Nos.: 4,237,344; 4,453,043; 4,137,429; 5,465,296; 5,475,750; 5,475,751; 5,742,666; 5,896,565; 6,100,811; and Re. 34,677. Importantly, the prior art includes my U.S. Pat. Nos. 6,259,787 B1 AND 6,263,069 B1. This statement of the prior art is not intended as an information disclosure document, but merely a series of references from which one interested in this field may get a general understanding of the art.

While the prior art shows various methods of activating telephones and the like, the present invention is novel, unique and useful in a variety of applications. Particularly, but not necessarily exclusively, the following are novel, unique and useful elements:

1. The use of switching devices such as the mercury-free switches as produced by Select Controls of Oceanside, N.Y., magnetic reed switches such as are available from Aleph International of San Fernando, Calif., and the novel, unique and useful new disturbance activated switches which I have conceived and developed in connection with the other features of this overall algorithm, method and apparatus;
2. The use of multiple motion activator elements to activate a single, or multiple, emergency telephone(s);
3. A latching relay circuit which prevents deactivation of an activated circuit for a predetermined time;
4. The ability to activate a telephone by a variety of contact means;
5. The ability to activate and use emergency telephones and the like when engaged in another activity without any distraction from the other activity;
6. The revolutionary novel, useful, and unique wireless signaling and emergency messaging system completely disclosed below; and
7. The use of a customary household telephone for general telephone communication purposes with the added feature of an emergency line which automatically dials to an emergency response center upon disturbance of a remote household item or other device and with a multiplicity of such items, all of which may be either overtly or covertly activated resulting in an algorithm for complete surveillance.

BRIEF SUMMARY OF THE INVENTION

There are many uses for hands free telephones and other signaling and messaging systems for monitoring, emergency, informational, and other uses. There are many so-called "hands free" emergency telephones. Some examples of such uses are elevator, parking lot, emergency tower, hotel locator, and the like telephones. In general such telephones are not truly "hands free" in that it is generally necessary to push a button, lift a receiver, or take some other such precise action to activate such telephones.

Heretofore systems for satisfying these needs all require expensive installation of equipment and they all require that a person activating the device must have some reasonable muscular ability and coordination, and must devote some direct attention to the system.

Frequently the ability to be unnoticed and/or imprecise in sending an alarm is important. For example, in banks, convenience stores, service stations, homes, and the like, the triggering of an alarm may well be easily detected by an alert intruder, thus causing a person who could otherwise activate an alarm to fail to activate an alarm.

I have found that even the most severely handicapped quadriplegic can generally move his/her head slightly, or make other simple movements such as involuntary or reactive movement such as striking out with a hand, arm, leg, or the like. Also, blind or injured persons who may have difficulty finding a precise button to push, or the like, may have no problem locating a large bar, a common household item such as a floor lamp, ornament, toy, or the like and causing it to be jarred or disturbed in order to activate an emergency telephone or the like.

I have studied this situation and all of the previously available equipment and systems. Nothing, even including my afore mentioned patents, has heretofore been completely capable of satisfying many requirements for emergency communication and the like.

I have now conceived and developed what I believe to be proper solutions to the situations outlined above.

I have accomplished this by activating emergency or other telephones or the like by means of impact or motion sensing device such as resiliently mounted rails, beams, toys, decorative ornaments, modules, or the like incorporating means to transmit an activation impulse to an emergency telephone or the like by hard wired means, and more importantly, by my newly conceived and developed wireless systems. The users of my algorithms, methods and apparatuses need merely to jar or come in contact with an easily contacted object such as a hanging bar, a module, a toy, a door or window, a floor lamp or the like. Such contact then commences an automatic series of steps and activities resulting in proper communication to a receiving telephone or other communication device without the necessity of cooperation of a person who may be incapacitated or incapable of full cooperation. A person at a receiving telephone or the like may then receive the communication and take appropriate action.

These same principles and items can be used for such situations as hospital bathroom alarms, nurse call systems, monitoring services, and the like.

It is common to have a means to summon help to a hospital bathroom by a string or the like hanging from a nurse call activation device, a local telephone or the like. Such means are generally unreliable, subject to frequent breakage or failure, or difficult to manipulate by disabled persons.

The receiving telephone or the like may have caller identification capability so that the phone number and/or location of the activated phone can be immediately identified.

The transmitting phone or device or the like may be programed in a manner known to those skilled in the art so that it will remain activated until it is reset (turned off) by disconnecting the receiving phone or by other means. Thus, it will be possible that any noise in the location of the activated phone may be heard through the receiving telephone even though an injured or disabled person or the like may be unable to speak.

Telephone monitoring systems for disabled or infirm persons are common. Such systems are generally expensive and require special installation and use of monitoring services or the like. As a part of my present algorithm, method and apparatus I have conceived and developed a superior monitoring system which may, also, be a burglar alarm system and may be a security system for the safety of persons at risk of intruder attack and the like. In this system I have combined the principles of my new motion activated switching devices with multiple alarm transmission capabilities including a very economical use of inexpensive telephones or the like for transmission of requests for assistance, warnings, messages, and the like. The system includes multiple inexpensive and non conspicuous motion sensors to insure that unwanted intruders and the like are unaware of the activation of the systems.

Throughout this patent application I may have used, and/or may use, the terms "cordless telephone", "cordless phone", "telephone", "phone", "cordless phone handset", and the like. It will be understood by those skilled in the art that "cellular telephones", "pagers", "radios" and other communication devices, the practical equivalent of, or substitute for, the specific devices described and illustrated, are intended to be included.

It is an object of this invention to provide a business model algorithm for emergencies and disabled persons which includes steps of: associating unseen unique motion detecting switching/transmitting equipment suitable to transmit a normally undetectable activation signal with at least one common article; associating at least one emergency telephone with receiving/switching equipment suitable to receive a transmission of an activation signal suitable to activate the emergency telephone into communication with at least one other telephone; causing motion to be imparted to the common article; causing the motion to activate the switching/transmitting equipment and transmit a telephone activation signal; causing the receiving/switching equipment to receive the activation signal and activate the emergency telephone; causing the activated telephone to transmit a communication to a preselected receiving telephone; causing the communication to be received by the pre-selected receiving telephone; causing the communication to be acted upon; and resetting the emergency telephone to enable it to be able to receive a new activation signal.

It is another object of this invention to provide a method for incapacitated, injured, ill, handicapped, and the like persons to give notice that they require attention;

It is another object of this invention to provide an emergency notification system which will not be recognized as existing or being activated by persons in the area where and when activated;

Another object of this invention is to provide a monitoring system by which persons can give notice of an emergency or other requirement without the necessity of speaking;

Another object of this invention is to provide an impact or other motion sensing operated communication activation method and apparatus;

Another object of this invention is to provide a method and means of communication by telephone or the like between severely handicapped persons and/or other persons;

Another object of this invention is to provide a method and means for enhanced safety in the use of cellular telephones and the like;

Another object of this invention is to provide method and means for communication by individuals under conditions preventing or limiting ability to visually locate emergency communication devices or the like;

Another object of this invention is to provide unique new, novel, and useful motion or contact detecting switching devices and the like;

Another object of this invention is to provide an inexpensive and superior monitoring and communication system.

The foregoing and other objects and advantages of this invention will become clear to those skilled in the art upon reading the description of a preferred embodiment, which follows, in conjunction with a review of the appended drawings.

DETAILED DESCRIPTION OF THE INVENTION

Figure 1:
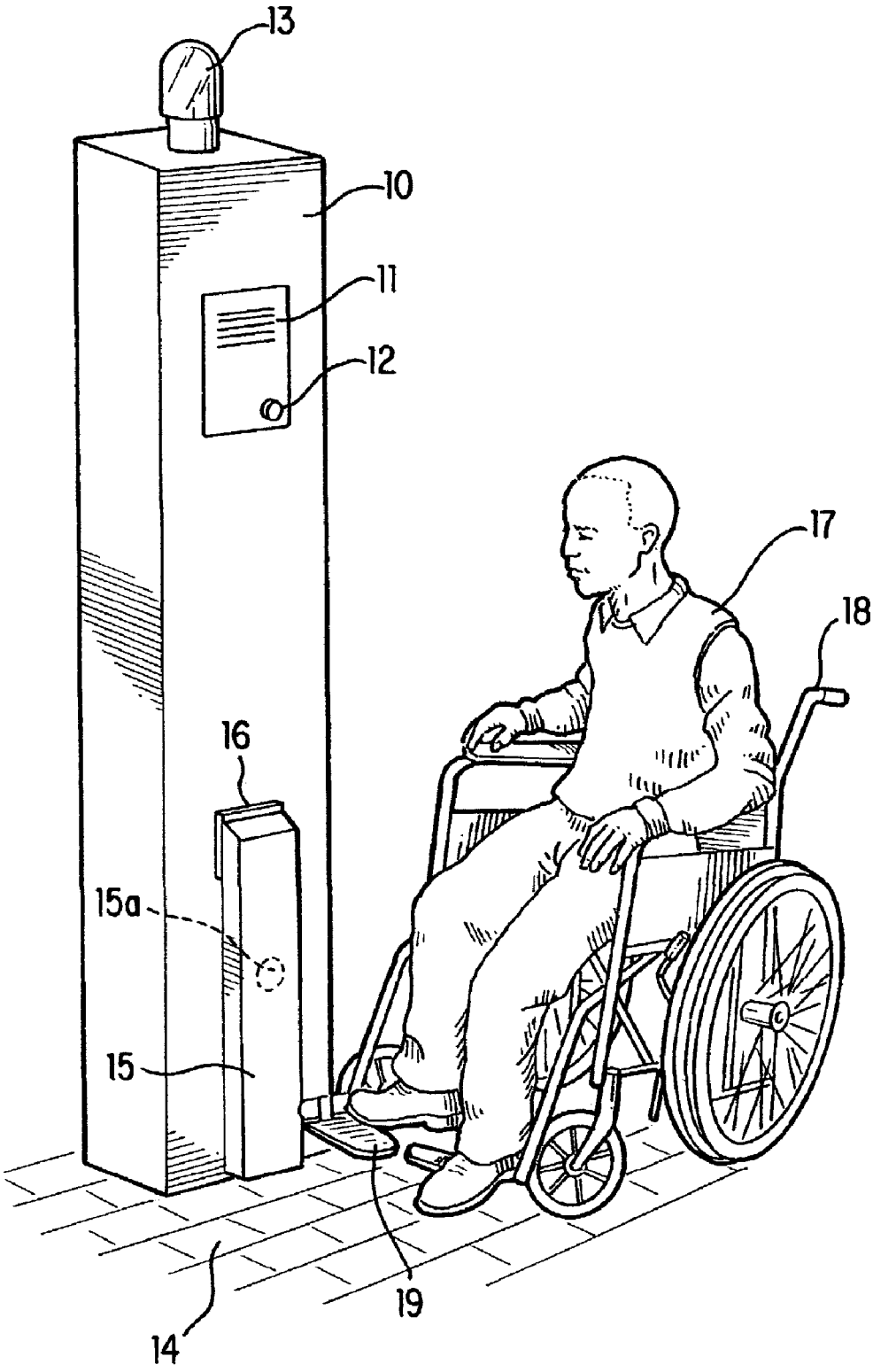
FIG. 1 is a schematic perspective of a disabled person in a wheel chair practicing a method of this invention in activating an emergency telephone.

Inventory of Items Identified by Numeral:

Numeral Item
10 emergency phone tower
11 emergency telephone
12 phone activation button
13 strobe light
14 base surface
15 emergency phone tower activator bar
15*a* transmitter/switch
16 resilient mounting
17 invalid
18 wheelchair
19 wheelchair foot rest
20 wall surface
21 toy snake head
22 snake
23 snake mounting to wall
24 child
25 foot kicking snake head
26 base surface
27 switch/transmitter
30 bathroom area
31 bathtub
32 bathroom activator bar
33 motion detector switch/transmitter
34 person
35 elbow striking activator bar
36 mounting of activator bar to wall
37 nurse call device
40 automobile
41 automobile seat back
42 automobile seat
43 cell phone equipped with activator switch
44 automobile driver
45 driver's left hand on steering wheel
46 driver's right hand hitting seat
47 steering wheel
48 activation switch
50 portion of building
51 wall
52 wall
53 floor
54 fire
54*a* smoke
55 emergency phone
56 emergency phone activation button
56*a* receiver/switch
57 phone activator bar
57*a* transmitter/switch
58 phone activator mounting to wall
59 employee
59*a* employee hand hitting activator
60 house layout generally
61 living room
61*a* front door
61*b* window
61*c* table
61*d* telephone
61*e* floor lamp
62 bedroom
62*a* door
62*b* window
62*c* door
63 bedroom
63*a* door
63*b* window
63*c* door
63*d* toy
64 kitchen
64*a* door
64*b* door
64*c* picture in frame
65 bathroom
65*a* activator bar
66 utility room
66*a* door
70 emergency phone
71 phone activator button
72 wire
73 wire
74 activator bar
75 resilient mounting
76 bracket
77 motion activated switch
78 wire connected to first phone button contact
79 wire connected to second phone button contact
80 emergency phone
81 phone activator button
81*a* push button contact
81*b* push button contact
82 lamp
83 wireless transmitter/switch

84 transmitted signal
85 wireless receiver/switch
86 wire
87 wire
88 receiver/switch contact
89 receiver/switch contact
90 disc magnet
91 side
92 side
93 end
94 end
95 bottom
95*a* top
96 magnetic reed switch
97 wires
98 hollow track
99 horizontal base line
99*a* angular relation of track to horizontal
100 multi-directional switch generally
101 hollow track
102 hollow track
103 hollow track
104 magnetic reed switch
105 magnetic disc
106 magnetic disc
107 magnetic disc
120 motion activated switch
121 wires
122 wireless transmitter
123 battery
124 transmitter activation switch
125 wireless signal
126 wireless receiver
127 wire
127*a* wire
128 relay
128*a* coil
128*b* switch
129 battery
130 telephone
131 push button phone activator switch
131*a* push button phone switch contact
131*b* push button phone switch contact
140 telephone
141 handset cradle contact
142 handset cradle contact
143 handset cradle switch
144 phone line
145 hot-line dialer
146 modular cord to telephone network
150 latching relay
151 latch switch
151*a* contact
151*b* switch
151*c* contact
152 battery
152*a* terminal
153 battery connection to coil contacts
153*a* wire
153*b* wire
154 reset coil
154*a* reset coil terminal
154*b* reset coil terminal
155 latch coil
155*a* latch coil terminal
155*b* latch coil terminal
156 reset switch
157 latch activation receiver/switch
158 motion activated transmitter/switch
159 signal FIG. 1 illustrates a common type emergency phone tower 10 upon a base surface 14. An emergency phone 11 known to those skilled in the art is mounted in connection with the tower. Frequently such a phone tower will have a strobe light 13 which normally activates when the phone is activated. A push button switch 12 is used to activate emergency phones. Many invalids are unable to reach up to push a button. In this case, an invalid 17 in a wheelchair 18 has approached the tower. An activator bar 15, which may be a hollow tubular member, a solid member, or an article of almost any shape carries within it a motion activated switch 15*a*. The activator bar is preferably resiliently mounted to the tower at 16. In this case, the invalid is able to activate the phone without pushing the button by contacting the activator bar with his wheelchair foot rest 19. This disturbs the switch which closes for a short period of time and activates the phone. The activation may be by hard wire through the activator bar and into the phone and connected in parallel with the push button switch contacts in a manner as illustrated and described in connection with FIG. 7 below, or it may preferably be by my new, unique, novel and useful wireless circuitry described in connection with FIG. 8, below, and otherwise described and illustrated in this patent application.

Figure 2:
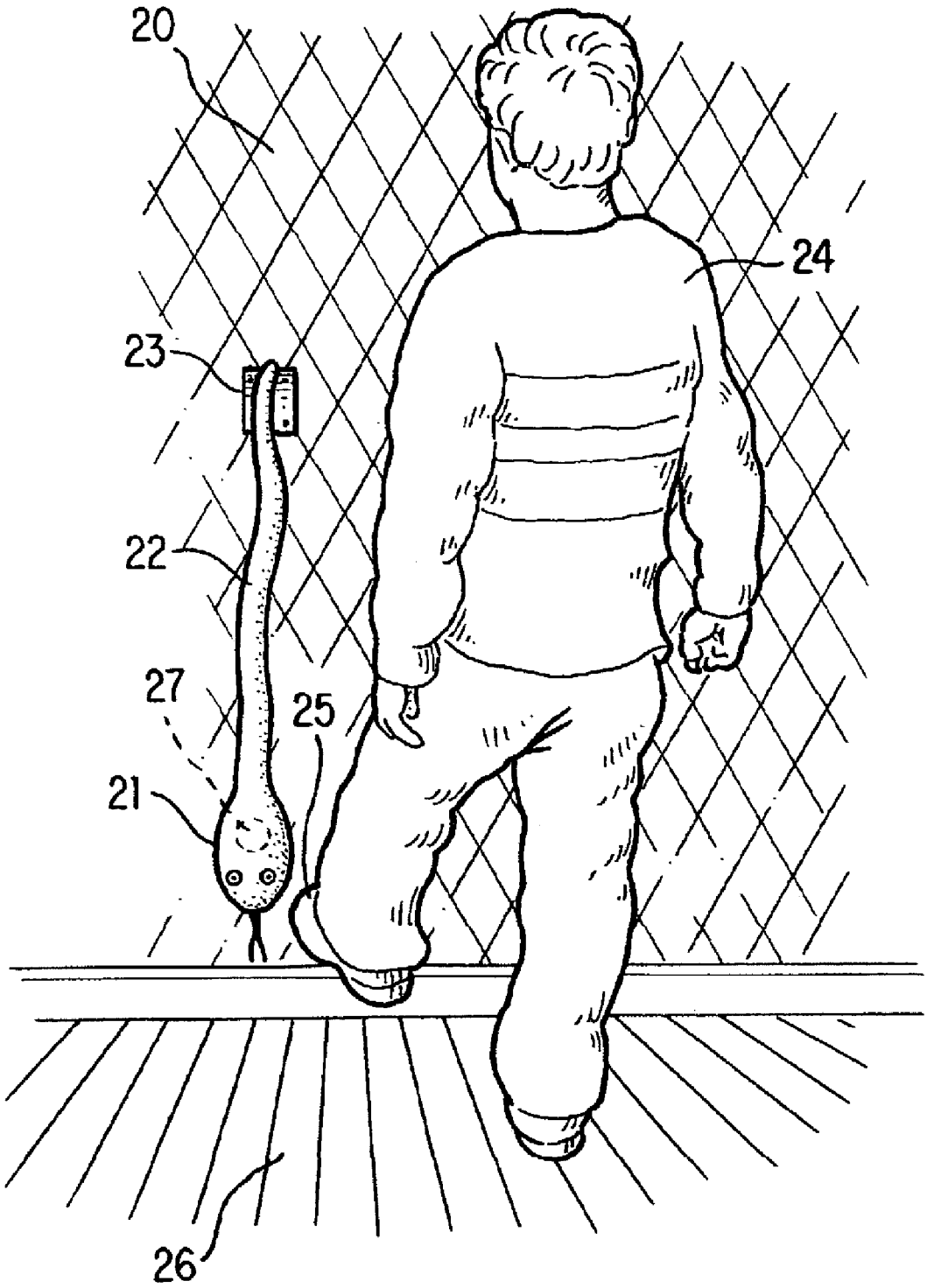
FIG. 2 is a schematic perspective of a child kicking a toy in a method of this invention to activate an alarm in a remote location.

FIG. 2 illustrates a situation which can be very important for safety of children and others. A child 24 is shown standing on a surface 26 which could be a floor in a child's room. The child is using his/her foot 25 to kick the enlarged head 21 of a toy snake 22 suspended adjacent a wall 20 by a bracket or the like 23. The snake head carries a switch/transmitter such as the one shown and described in FIG. 12 below. There have been many child abductions in recent times. Most young children are incapable of resisting abduction or fighting against an adult abductor. However, a child will understand that if he/she is in trouble, in his/her room, help will come if he/she kicks a toy snake or other object. The transmitter sends a signal activating an emergency phone, alarm, or the like as described and shown (FIG. 12 for example) in this patent application.

Figure 3:
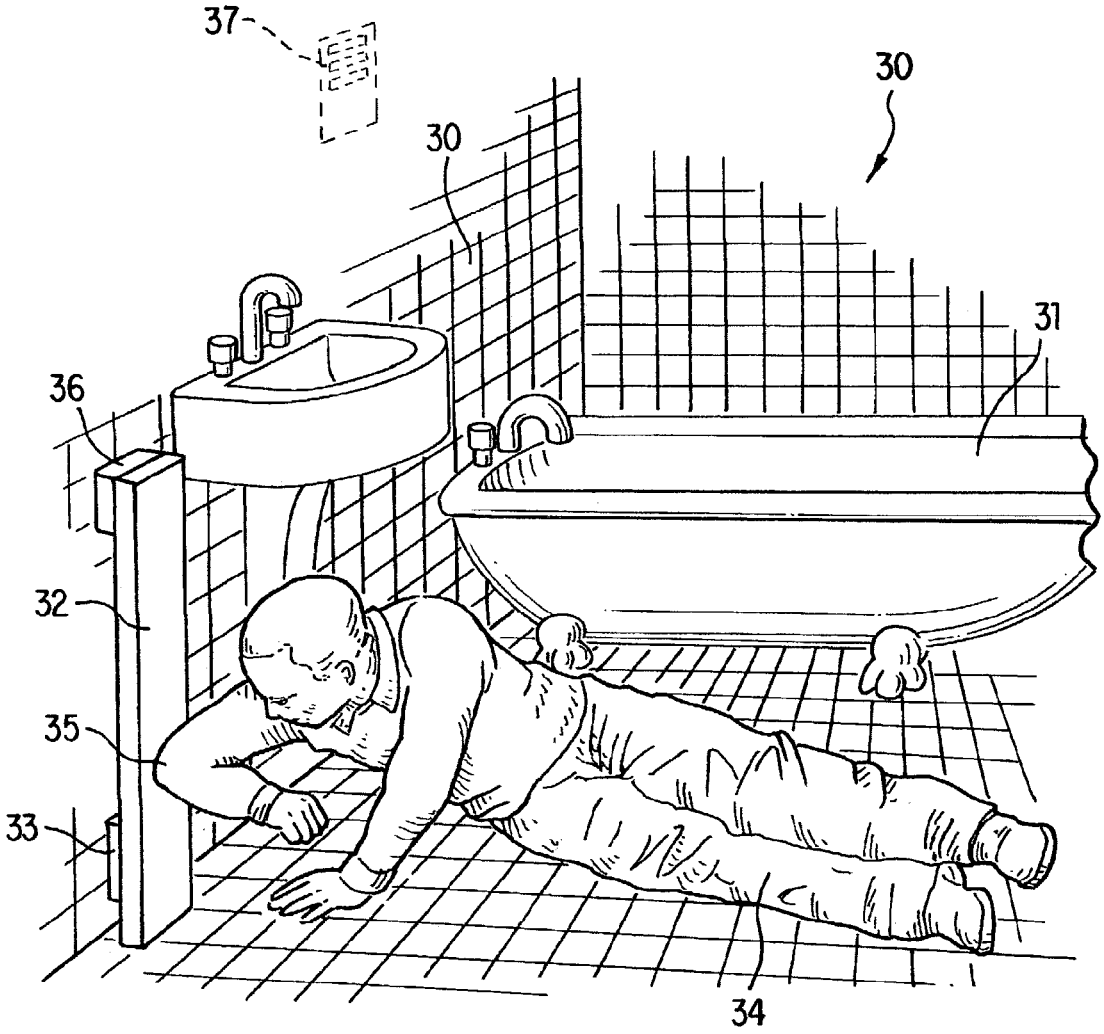
FIG. 3 is a schematic perspective of a person who has fallen in a bathroom using an apparatus of this invention to practice a method of this invention to communicate a need for help.

FIG. 3 illustrates a portion of a bathroom 30. This could be any bathroom, but it is particularly important for hospitals and the like. In hospitals it is quite common for bathrooms to have a cord or the like hanging down someplace so that when a patient falls the patient can pull the cord to summon a nurse for help. A cord frequently breaks and becomes useless. Also, many patients are unable to grasp a cord. This is particularly true of patients who have suffered severe strokes and the like. In the illustration here the patient or person 34 has fallen and is unable to stand after getting out of the tub 31. A bathroom activator bar 32 is resiliently mounted 36 to wall 30*a* and carries motion detector transmitter/switch 33. The patient, while perhaps unable to use his/her hands, will probably be able to strike the activator with his/her arm or elbow 35 thus causing transmission of a signal to activate a nurse call device 37 located outside the bathroom.

It is important to note that many patients in hospitals or otherwise are unable properly to activate nurse call push buttons or the like. However, such patients are usually able to strike out with an arm or leg and hit an activator device carrying a motion detecting switch/transmitter (either wireless or hard wired), thus obtaining assistance when needed. This makes the present invention valuable for normal nurse call and other communication purposes in hospitals and the like.

Figure 4:
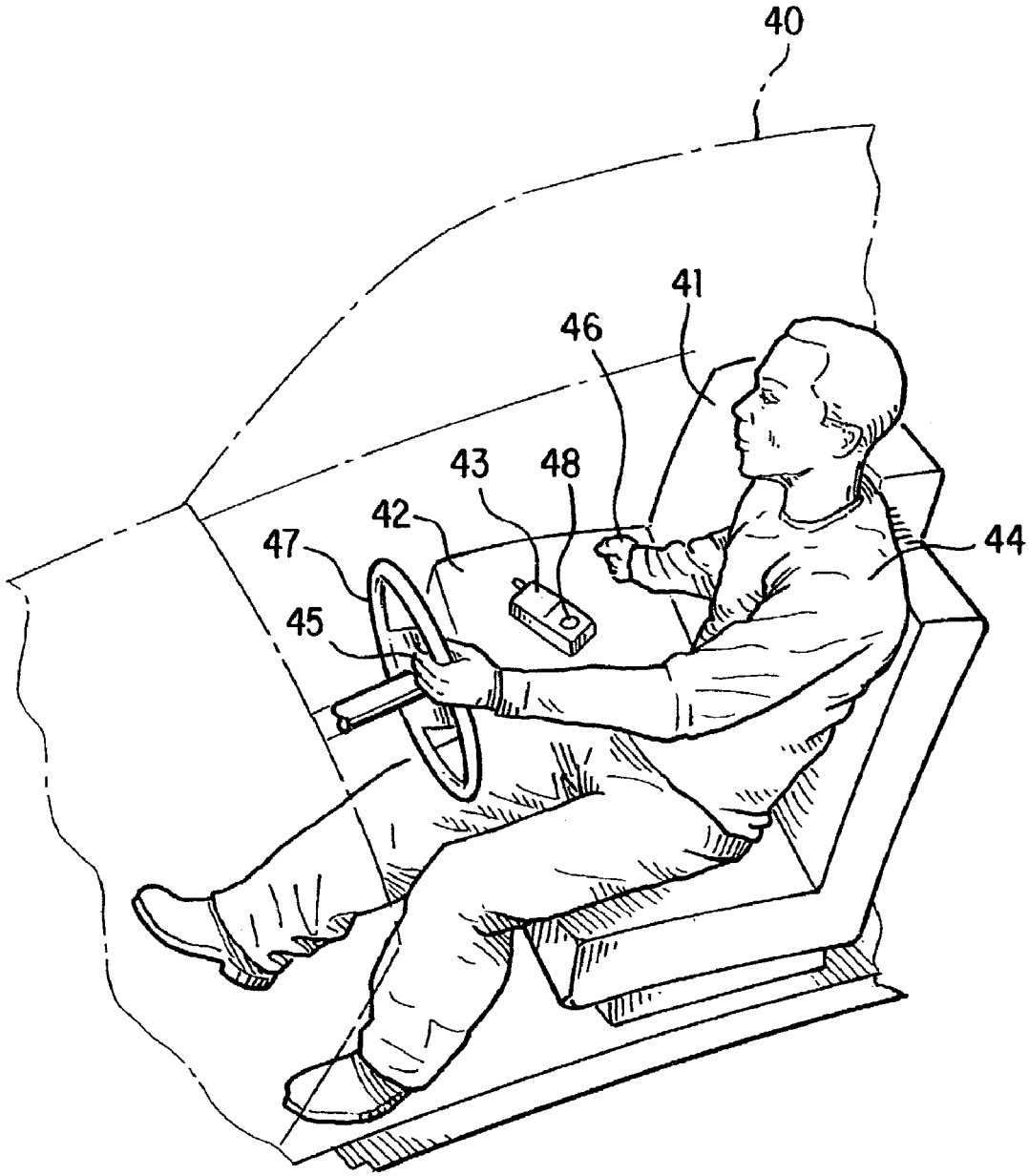
FIG. 4 is a schematic perspective of an automobile driver using an apparatus of this invention in practicing a method of this invention.

FIG. 4 shows an important use of this invention in connection with cellular telephones in automobiles and the like. At present there is much attention given to the dangers of cellular telephone users while driving automobiles. There are hands-free devices available. However, the activation of cellular phones, even with hands-free accessories, is still somewhat distracting. In my present invention, a cellular phone can be activated with no distraction, since an ordinary cellular phone equipped with motion sensing means can be activated (placed in off-hook mode) with no distraction (as one example—by merely pressing down on a passenger seat on which the phone may be resting, cellular phone can be activated). This can be done with no diversion from full attention to driving and no diversion of the eyes of the driver from the road and vehicles in the vicinity. In FIG. 3 a driver 44 of automobile 40 is seated on automobile seat 42 which has a customary back 41. A cellular phone 43, equipped with activation switch 48 is resting on the seat 42. If the phone rings, the driver, without removing hand 45 from the steering wheel 47 and without even diverting his eyes from the road can press on, or hit, the seat with the driver's left hand 46 which will give enough motion to activate the phone so that the driver can receive the call with no diversion of attention from driving.

Figure 5:
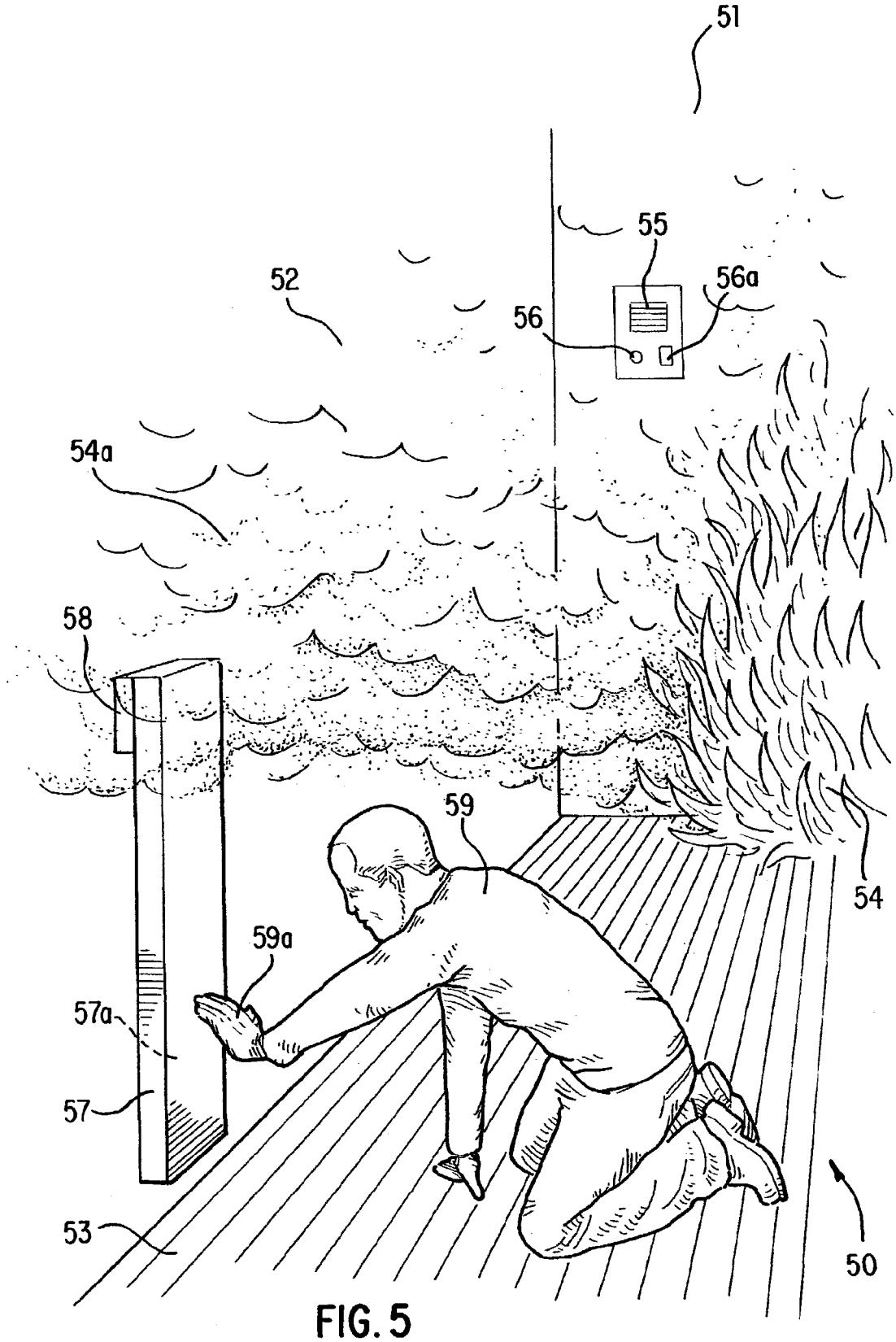
FIG. 5 is a schematic perspective of a person practicing a method of this invention in conditions of fire or the like preventing full vision or access to emergency communication device.

FIG. 5 illustrates a portion of a building 50. An emergency phone 55 or the like with activation button 56 and receiver/switch 56*a* is located on wall 51. A fire 54 is burning on the floor 53 and wall 51. The entire building is filled with smoke 54*a*. An employee 59 in the building is unable to stand and walk due to the smoke but is able to crawl along the floor 53 where there is normally a small layer of relatively clear air. An activator bar or the like 57 carrying transmitter/switch 57*a* is resiliently mounted at 58 by a hinge or the like to wall 52. The employee can crawl on the floor along the wall 52 until he/she comes in contact with the activator bar. The contact with the activator bar will cause transmission of a signal (as is explained in connection with FIG. 12) to receiver/switch 56*a* thus activating the phone. The employee can then shout information concerning the situation to someone at a phone receiving the transmission from the phone 55.

Figure 6:
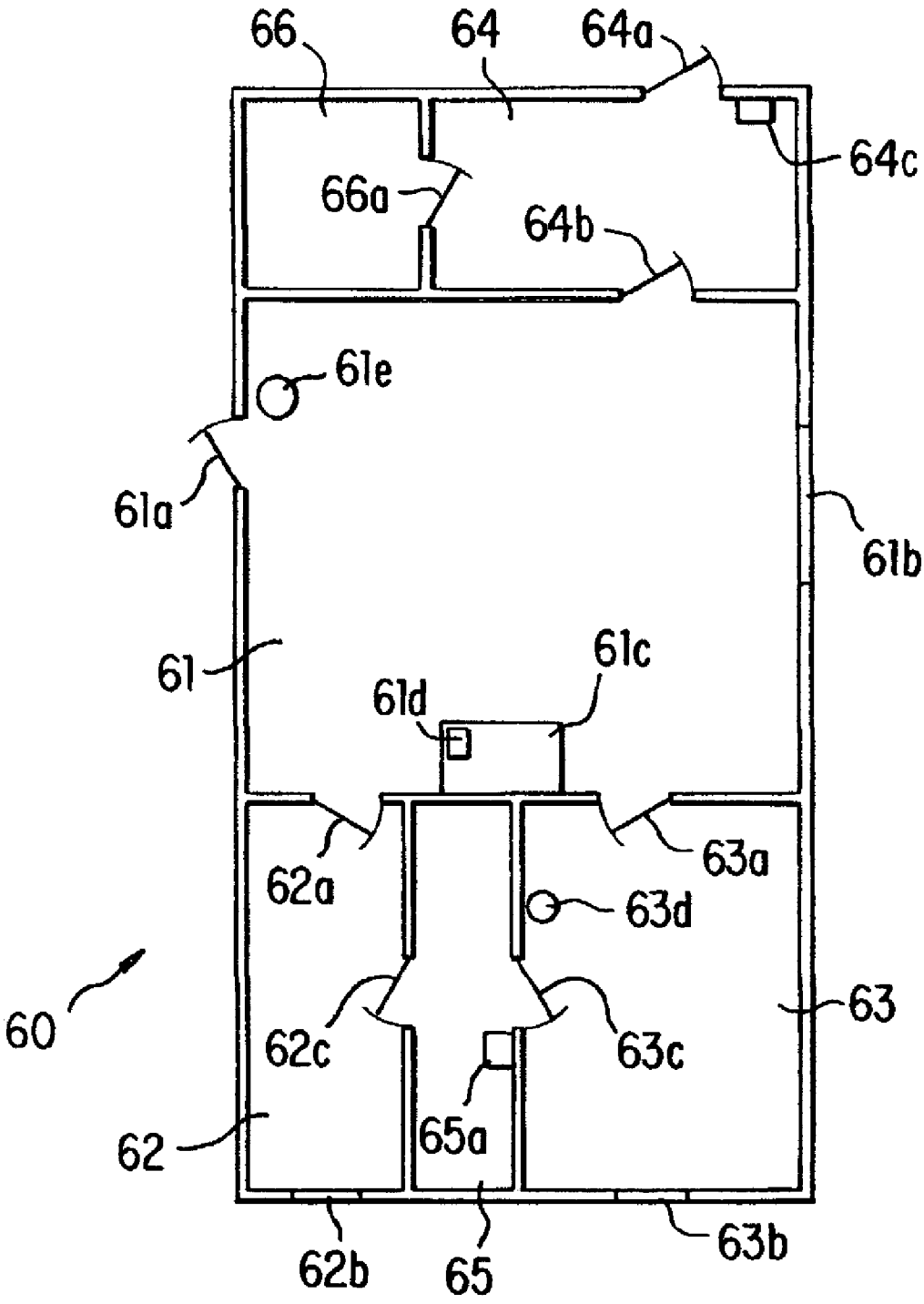
FIG. 6 is a schematic diagram of a home having multiple apparatuses of this invention suitable to practice methods of this invention.

FIG. 6 shows a house layout 60 generally. A main living room 61 has door 61*a*, window 61*b*, table 61*c*, telephone 61*d* and a floor lamp 61*e*. Bedroom 62 has doors 62*a* and 62*c*, and window 62*b*. Bedroom 63 has doors 63*a* and 63*c*, window 63*b*, and a floor lamp 63*d*. Bathroom 65 has an emergency activator 65*a* which is similar in purpose to the activator bar of FIG. 3. Kitchen 64 has doors 64*a* and 64*b* and a picture in a large frame 64*c*. Utility room 66 has a door 66*a* leading to the kitchen. Security of a house or other building to prevent entry by unwanted intruders is normally expensive and difficult. Utilizing the activator transmitter/switch and receiver/switch systems of this invention very economical and comprehensive building security can be achieved. The floor lamp 61*a*, activator 65*a*, toy 63*d*, and picture frame 64*c* can each carry a concealed motion switch/transmitter as described in FIG. 12. The telephone 61*d* will be equipped for activation by a receiver/switch. If an intruder, even an armed and deranged one, bursts into the room 61, a home occupant need only apparently innocently bump into the lamp 61*e*, the picture frame 64*c*, the toy 63*d*, or the activator 65*a* and the phone will alert someone at a receiving phone. In this manner, a home or other building can be provided with unobtrusive articles which will silently activate an emergency or other telephone or other communication device. Additionally, where desired the same arrangements may sound an audible alarm or activate flood lights or the like, as will be understood by those skilled in the art. Windows can be fitted with transmitter/switches to accomplish the desired ends.

Figure 7:
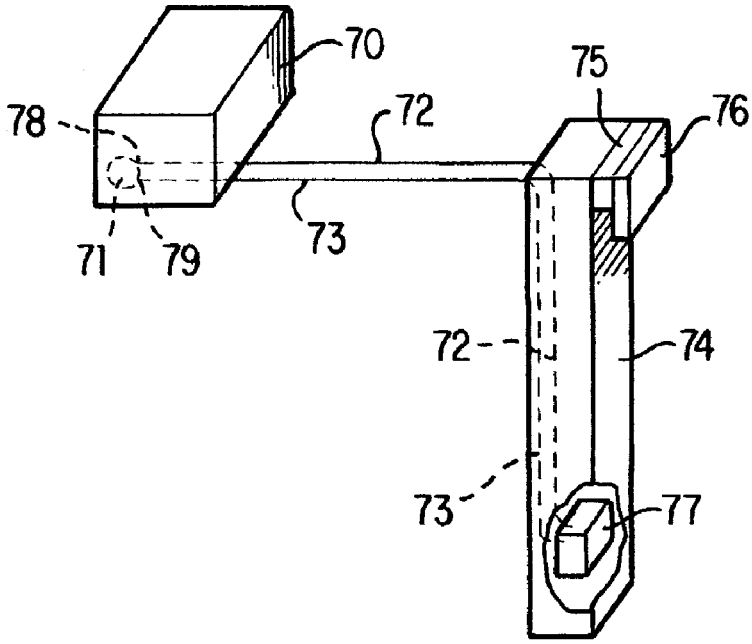
FIG. 7 is a schematic diagram of circuitry and elements of an apparatus of this invention suitable for practicing methods of this invention.

FIG. 7 illustrates an emergency phone activator system which is a hard wire system. Emergency phone 70 has activator push button 71 which has two contacts 78 and 79. When the push button is pushed, the contacts 78 and 79 are connected momentarily which activates the phone and calls a pre-programmed receiving telephone as will be understood by those skilled in the art. The phone may be programmed so that the connection to another phone will remain active until the receiving phone disconnects. Thus, if there is an emergency requiring the line to be kept open an extended time this will be accomplished and the communication will not be terminated until it is desired to do so by disconnecting the receiving phone. The contacts 78 and 79 are connected by wires 72 and 73 to motion activated switch 77 carried by activator bar 74 which may be a tubular member or the like which is resiliently mounted at 75 to a bracket or the like 76 which can be mounted to a building structure, and article of furniture, or the like. The motion activated switch may be an impact switch of the mercury free type available from Select Controls of Oceanside, N.Y. or the impact switches of Aleph International or San Fernando, Calif. Preferably, however, the motion activated switch will be of the type of my new invention as shown and described in connection with FIGS. 9, 10 and 11 below.

Figure 8:
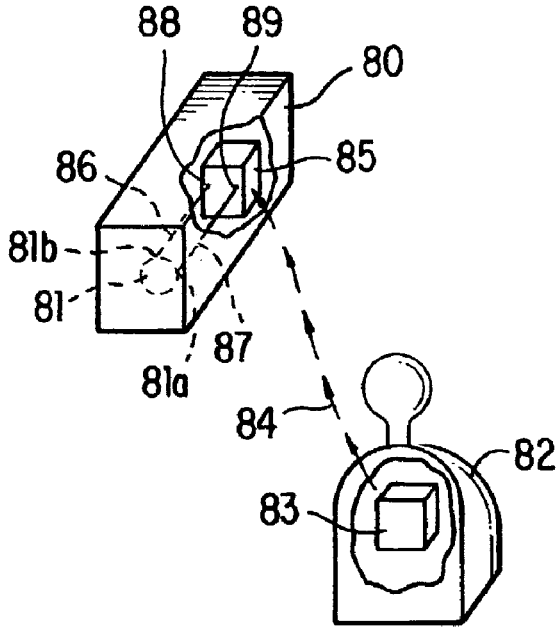
FIG. 8 is a schematic diagram of circuitry and elements of an alternate apparatus of this invention suitable for practicing methods of this invention.

FIG. 8 illustrates the features of the wireless version of this invention. An emergency phone or the like 80 has a customary push button activator 81. A wireless receiver/switch 85 is mounted within (or without) the emergency phone housing. Two wires 86 and 87 connect from the wireless receiver/switch contacts 88 and 89 to the two push button contacts 81*a* and 81*b*. An object, in this case a lamp 82, carries a motion activated transmitter/switch 83. The signal 84 from the transmitter/switch is received by receiver/switch 85 and closes the contact between receiver/switch contacts 88 and 89. This has the same effect as would pushing the push button and thus activates the phone by shorting across 81*a* and 81*b*.

In experimenting with the wireless version of this invention I found that I can modify existing and previously known radio frequency devices to accomplish new, novel, useful, unusual, and unexpected results for my purposes. I have discovered that I can modify the existing "Trine" wireless door chime model SL-6140-A available from Desa International of Bowling Green, Ky. and on retail sale at Wal-Mart stores to be satisfactory transmitters and receivers for the purposes set forth in this patent application. I modify the transmitter by removing the push button and connecting the two push button contacts to the two wire contacts of my new motion detecting switches which are shown and described in FIGS. 9, 9A, 10 and 11 below. When the switch is activated the transmitter sends its signal to the receiver. The receiver of the same Trine door chime unit is modified by disconnecting the two output leads from the speaker and connecting these leads to the coil of a magnetic reed relay (known to those skilled in the art). A specific example of such a relay which is suitable is Radio Shack catalog number 275-232 5 volt DC reed relay. The two relay output contacts are then connected to the two push button contacts on an emergency phone or the like. In operation, the transmitter is activated by the motion switch as explained below. The transmitted signal is received by the receiver/switch. The receiver output instead of going to activate the speaker and sound a chime is now diverted to the coil of a reed relay and thus closes the relay which activates the telephone (or other device). I did find one interesting problem. In all of the commercially available impact switches I have experimented with, the results have been satisfactory in general when using a hard wire version of the invention. However, the adjustability of the amount or degree of motion or impact for proper activation has been wanting. In fact, most impact type switches I have found are not adjustable at all. Additionally, I found that the commercially available impact switches would generally fail to provide sufficient time of electrical contact for proper activation of the wireless transmitters. The wireless units I have found and worked with generally require more than an instantaneous contact to duplicate the relatively lengthy contact provided by a push button switch. After considerable thought and experimentation I conceived and developed a motion detection switch which is infinitely adjustable as to force and/or degree of motion or contact required for activation. My important developments, discoveries, teachings, and inventions related to motion detecting, impact, and like switches are revealed in the teachings and disclosures throughout this patent application as well as particularly in the discussion of FIGS. 9 through 12A below.

Figure 9:
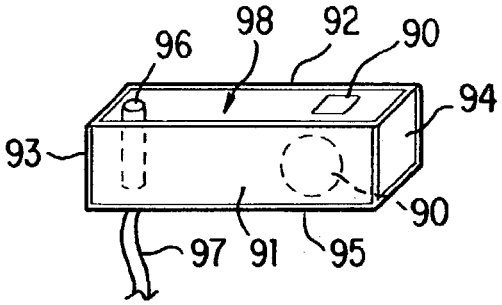
FIG. 9 is a schematic perspective of a motion or contact detecting electrical switch suitable to practice methods of this invention.
Figure 10:
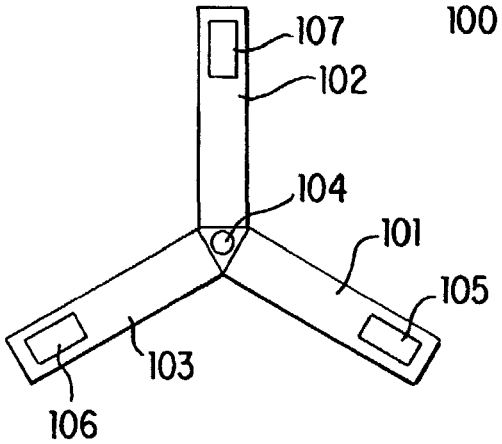
FIG. 10 is a schematic top elevation of an alternate motion or contact detecting electrical switch suitable to practice methods of this invention.
Figure 11:
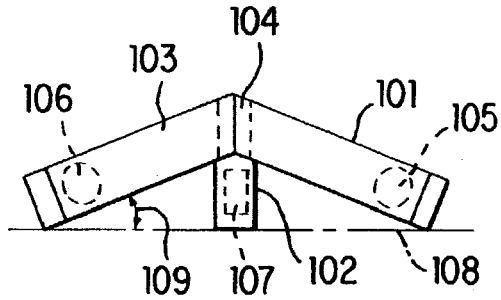
FIG. 11 is schematic front elevation of the device of FIG. 10.
Figure 12:
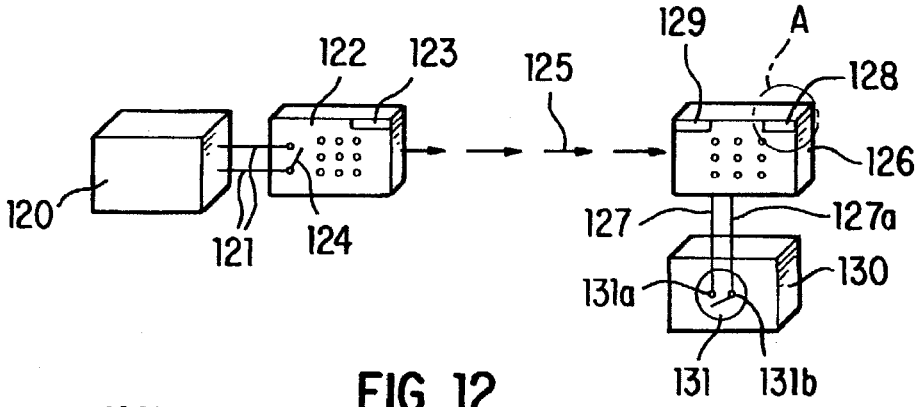
FIG. 12 is a schematic diagram of elements and operation of an embodiment of this invention.
Figure 12A:
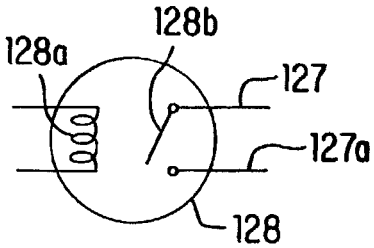
FIG. 12A is an enlarged schematic diagram of relay 128 encircled and labeled "A" on FIG. 12.

FIG. 9 shows the first and most fundamental principle of my new, novel, unique, and useful motion detecting switch. FIGS. 10 and 11 reveal a more complex and infinitely alterable version of my new motion detecting switch. FIGS. 12 and 12A show the sequencing of the actions in the wireless activation of telephone and the like from a motion detecting switch.

Figure 9A:
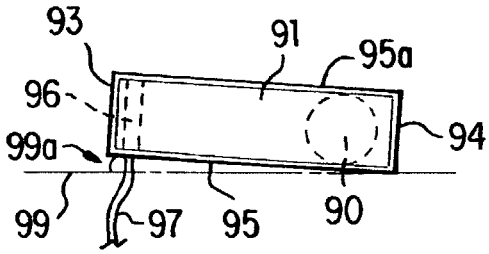
FIG. 9A is a schematic side elevation of the device of FIG. 9 and with a top enclosure and items in phantom.

FIGS. 9 and 9A show a hollow track 98 formed by two sides 91 and 92, two ends 93 and 94, a bottom 95, and a top 95*a* (the top is removed in FIG. 9). The hollow track is formed of non-magnetic material. A magnetic reed switch 96 (known to those skilled in the art) is adjacent track end 94. The reed switch may be either in the track as shown or it may be exterior the track. A round disc magnet 90 is within the track. The track will be mounted in association with an object in such a manner as to be normally at an angular relationship 99*a* to the horizontal 99 as indicated in FIG. 9A. As shown in FIG. 9A, the disc magnet will be held by force of gravity as shown. If the track, or an object with which it associated is disturbed by an impact against track end 93 or by track end 94 rising, the disc magnet will roll toward track end 93. The disc will come to a position where its magnetic field activates the reed relay. The wires 97 which will have the effect of closing the contacts of a transmitter or phone push button or the like. The rolling of the disc magnet into and out of the zone in which the reed relay is activated takes enough time to simulate the pressing of a push button and thus provides the necessary time properly to activate. Also, the amount of tilt for the at rest position can be infinitely adjustable to accommodate for any force or amount of movement to be required for activation.

FIGS. 10 and 11 show a multi-directional motion detecting switch 100. There are three hollow tracks 101, 102, and 103 (each is similar to the track of FIGS. 9 and 9A). The three tracks are joined by means known to those skilled in the art in such manner that each track is at approximately 120 degree horizontal angular relation to each of the other tracks and the three are each at an angular relationship to the vertical with their joined ends elevated above their non-joined ends. Each track contains a disc magnet 105, 106, and 107. A magnetic reed switch 104 is adjacent the joined ends of the tracks. Thus, if the switch is subjected to pressure or angular disturbance sufficient to move at least one of the disc magnets into the activation field of the reed switch, the switch will be closed. As with the switch of FIGS. 9 and 9A, the amount of force and/or movement required to move the disc magnets can be virtually infinitely adjustable by varying the angular relationship 109 of the tracks to the horizontal 108 (the angular relationship 109 as only been shown for track 103, but it will be understood this will apply to all tracks).

I have found that the switches utilizing disc magnets have many important uses other than those described here. For example, a magnetic disc switch as described here can be utilized to detect infinitesimal changes in the attitude of a building or the like. A minute change of the horizontal or vertical alignment of a building or the like can be detected and appropriate signals by wireless devices can alert persons to possible dangerous changes in the earth, or a foundation, or a piece of machinery, or the like can be detected and recorded by my new disc magnet motion detecting switch.

FIGS. 12 and 12A illustrate the elements and the sequencing of the operation of a system of this invention. A motion activated switch 120 is connected by wires 121 or the like to wireless transmitter 122. The transmitter is powered by battery 123. When the switch 120 is activated by motion or the like it causes wireless transmitter/switch 124 to transmit signal 125 which is received by receiver 126 which is powered by battery 129. The receiver causes electrical current to flow, as previously explained, through the output leads and into the coil 128*a* of relay 128. This causes the relay switch 128*b* to close. Wires 127 and 127*a* are connected to telephone 130 push button 131 contacts 131*a* and 131*b*. This action is the same as though the telephone push button 131 had been pushed, and the telephone 130 is activated. It is to be understood that other devices such as alarms, lights, and the like can be activated in the same manner.

Figure 13:
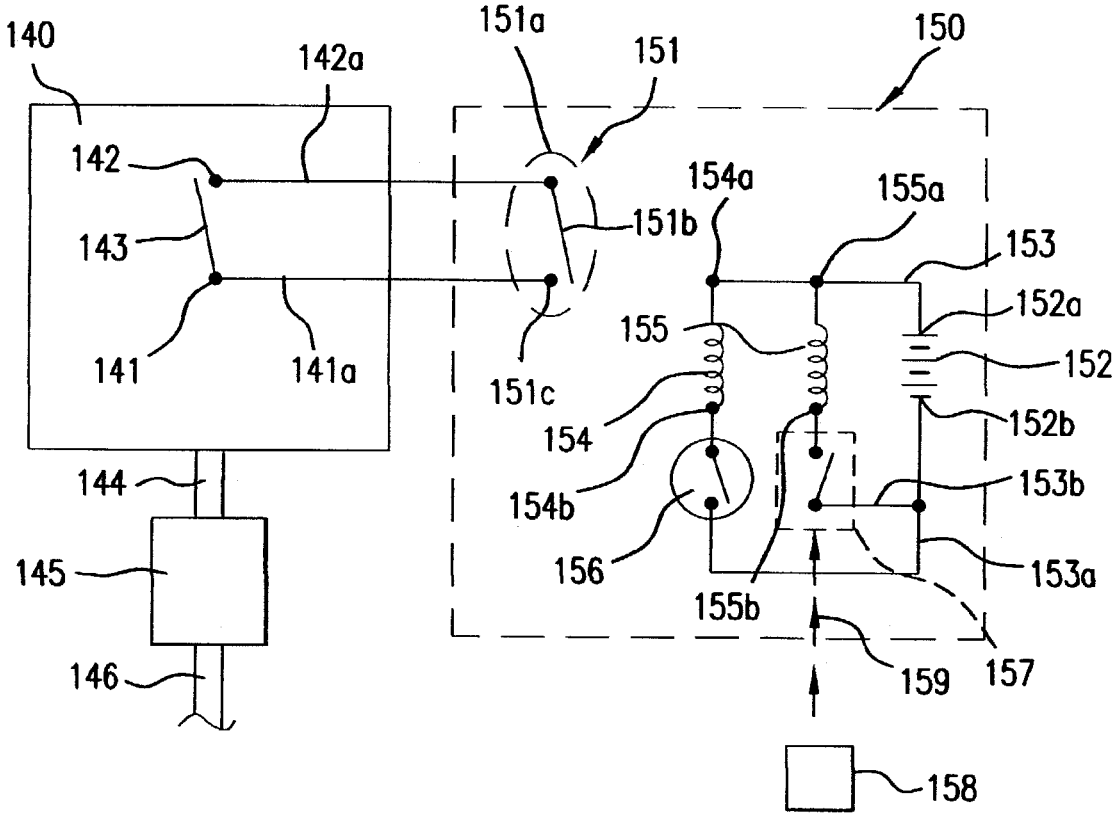
FIG. 13 is a schematic diagram of elements and circuitry of a telephone activation and monitoring method of this invention.

FIG. 13 is a schematic diagram showing the elements and circuitry of a common telephone and its activation by motion sensing and the like. A telephone of virtually any type 140 (an example of an inexpensive telephone which can be modified as shown and described here is Lennox Sound model MAC PH-301 available from Lenoxx Electronics of Carteret, N.J.) having a handset cradle switch 143 with handset cradle activating contacts 141 and 142 which become connected and the phone activated when the handset is lifted from the cradle. The telephone is connected by modular cord 144 to an automatic dialer 145 (for example Viking Electronics programmable tone dialer model K-1900-5 available from Viking Electronics of Hudson, Wis.). The dialer is connected to telephone network by modular cord 146. A latching relay 150 or the like (known to those skilled in the art) is utilized to activate switch 143 to close a contact between the cradle switch contacts 141 and 142. The switch element 151 of the latching relay is activated as described below so that contact element 151*b* closes between contacts 151*a* and 151*c* which makes a contact between cradle contacts 141 and 142 through wires 141*a* and 142*a*. The latching relay is powered by battery 152 which is connected at terminal 152*a* by wiring 153 to terminals 154*a* and 155*a* of reset coil 154 and latching coil 155 respectively. Battery terminal 152*b* is connected to receiver/switch 157 (normally open but will close on receiving signal 159 from motion activated transmitter/switch 158) by wires 153*a* and 153*b*). Motion activated transmitter/switch 158 and receiver/switch 157 will be similar to the transmitter/switch and receiver/switch arrangement shown and described in connection with FIG. 12, as will be understood by those skilled in the art.

The monitoring/alarm/emergency/phone activation system described and illustrated in connection with FIG. 13 could also be modified to utilize a common telephone which has the capability of being programmed (known to those skilled in the art) in such manner that one, or a series of, number(s) will be called when the telephone is activated by the receiving/switch circuit. In all cases, the telephone can be manually operated in a customary manner as will be understood by those skilled in the art.

Some of the terms used in this patent application are defined as follows: "motion detection", "motion detecting" or the like means a device such as an electrical switch or the like which is activated by sensing motion to itself or an article with which it is associated; "transmitter/switch" or "switch/transmitter" and the like means a device which will transmit a signal or message or communication to another device or location or to a person or the like; "receiver/switch" or "switch/receiver" or the like means a device which will receive a signal or message or communication from another device, location, or person; "common article" means any type of generally recognizable nature such as furniture, toys, windows, doors, lamps, utensils, and the like; "common telephone" means any type household telephone or the like.

By this reference I incorporate the claims and abstract which follow within this detailed description of the invention the same as though they were fully set forth here.

In the event I shall fail to claim a patentable feature of this invention, such failure to claim shall be due to inadvertence and not due to any intention to dedicate or abandon such feature. In such event, upon discovering the same I shall take any appropriate action to rectify the same.

While the embodiments of this invention shown and described are fully capable of achieve the objects and advantages desired it is to be understood that such embodiments are for purposes of illustration only and not for purposes of limitation.

What is claimed is:

1. Motion sensing electrical switch means comprising:

magnetically activated electrical switch means; a multiplicity of track means each of which has a first end adjacent the magnetically activated electrical switch means with its second end radially extending away from the magnetically activated electrical switch means and is at an angular relationship to each of the other track means and each of which is suitable for a magnetic disc to roll upon between said ends.

* * * * *